United States Patent [19]

Foland

[11] Patent Number: 4,602,783

[45] Date of Patent: Jul. 29, 1986

[54] POCKET EXERCISING DEVICE

[76] Inventor: Claud J. Foland, 1541 Bavona, Apt. 7, St. Louis, Mo. 63138

[21] Appl. No.: 590,360

[22] Filed: Mar. 16, 1984

[51] Int. Cl.[4] ..... A63B 5/00; A63B 21/00; A63B 21/02

[52] U.S. Cl. ..... 272/116; 272/67; 272/135; 272/137

[58] Field of Search ..... 272/67, 93, 116, 137, 272/135, 126; 273/1 G, 1 GH; 446/247, 248, 253, 254; D21/98, 198

[56] References Cited

U.S. PATENT DOCUMENTS

D. 226,390 2/1973 Margolin ..... 272/67 X 780,571 1/1905 Moore ..... 446/254

2,697,896 12/1954 Ischinger ..... D21/98 X

OTHER PUBLICATIONS

The Washington Post, Aug. 10, 1971, p. A18, "Chest Exerciser".

*Primary Examiner*—Robert E. Bagwill

*Assistant Examiner*—Kathleen D'Arrigo

[57] ABSTRACT

A pocket exercising device wherein a central hollow annular ring is coupled to a pair of line loops which are threaded through apertures in the central ring and cross within the inner space of the annular ring and the lines are each connected to separate handles.

1 Claim, 2 Drawing Figures

POCKET EXERCISING DEVICE

BACKGROUND OF THE INVENTION

It is contemplated that the hand held exerciser described herein will provide an exercising device which will serve not only those individuals desiring to develop muscles greater than average but will provide a device which functions to improve muscle tone and further will serve as a therapeutic device for persons who have suffered serious illness or injury or who are likely candidates therefor due to their physical condition or occupational working conditions or style of life.

Of the many devices presently available for exercise there are drawbacks in that they require a considerable period of time for each period, are considerably bulky and therefore are not compatible with regular transportation, require particular clothing or attire or may just require a particular space or area to perform the exercise. Another drawback is the fact that the devices that are available generally are designed for persons having a good degree of muscle tone at the outset and thus do not provide a device readily usable for persons in a weakened or out of shape condition.

SUMMARY OF THE INVENTION

It is therefore an object of the present invention to provide an exercising device which is readily useful for those persons who have available intermittent brief moments to perform exercising activities and who have need for a device which requires essentially no preparation, requires no special attire or exercise area and may be readily used by individuals whose condition is considerably weakened.

It is a further object of the present invention to provide such a device which is readily carried in the pocket and is comprised of a hollow, lightweight annular ring, in conjunction with a pair of hollow, lightweight annular handle rings, wherein the handle rings are coupled to the main ring by loops of line.

A further object of the present invention is to provide such a device which is simply and economically manufactured and used.

These, together with other objects and advantages which will become subsequently apparent, reside in the details and construction and operation as more fully hereinafter described and claimed, reference being had to the accompanying drawings forming a part hereof, wherein like numerals refer to like parts throughout, and in which:

DETAILED DESCRIPTION OF INVENTION

Figure 1:
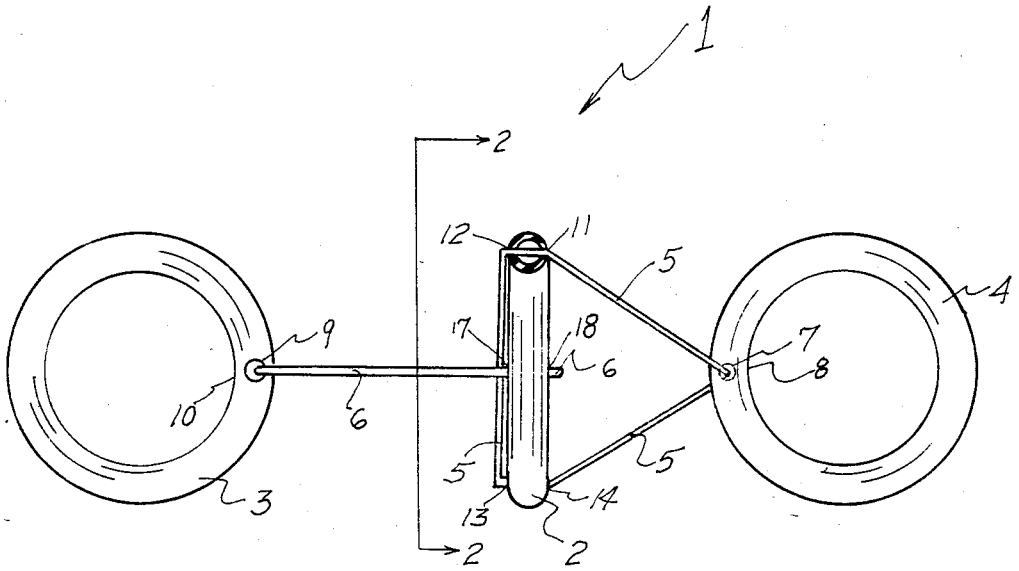
FIG. 1 is an elevation view of a pocket exerciser device constructed in accordance with and embodying the present invention.

Referring now in more detail and by reference characters to the drawings which illustrate practical embodiments of the present invention, FIG. 1 is an elevation view of a pocket exerciser device, 1, constructed in accordance with and embodying the present invention.

Figure 2:
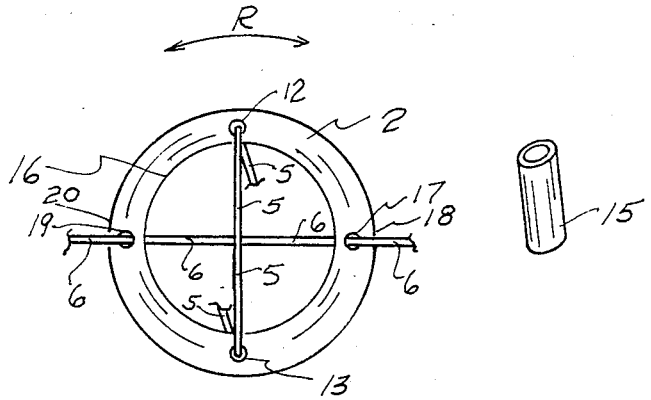
FIG. 2 is an end view of the device shown in FIG. 1 and a damper cylinder used in an alternate embodiment of the present invention.

As shown in FIG. 1, the exerciser device comprises a center ring, 2, two handle rings, 3, and, 4, a line loop, 5, connecting rings, 2, and, 4, and a line loop, 6, connecting rings, 2, and, 3. As shown in FIG. 1 and FIG. 2, the handle rings, 3, and, 4, are provided with aligned apertures, 7, and, 8, and, 9, and, 10, while the center ring, 2, is provided with four pairs of aligned apertures, 11,12,13,14,17,18,19, and 20.

An alternate embodiment to the present invention is provided with cylinders, 15, which are disposed about line, 5, and, 6, within the inner space of ring, 2, and tend to stabilize device, 1.

In the preferred embodiment of the invention the lines, 5, and, 6, are constructed of nylon braided line, **401*b*** test, doubled. Use of such line material allows the ends to be heat sealed and thus permits a knot to be formed thereby forming a loop after threading through the rings.

In the preferred embodiment the rings are preferably hollow annular rings constructed of a light weight plastic material and are of a diameter of approximately three inches in order to be pocket type devices. Of course the present invention is not to be limited to devices of that particular size.

In operation the user simply holds one ring in each hand with the lines held relatively taut and the center ring is disposed in front of the user and then a slight rotational motion to the center ring and then pulls the handle rings away from each other. The initial rotational motion tends to wind the lines in one direction and upon pulling the rings apart the tendency is for the center ring to continue past the neutral or unwound point thus causing the lines to wind upon each other in the opposite direction. Further pulling on the handles causes the winding to build rapidly in period, indicated by the rotational direction arrow labeled R, coinciding with the pulling of the handles with a resultant pull on the arms of the user which varies with the amount of pull exerted by the user. When the center ring has completed its wind up cycle and reverses direction the user pulls the handles apart causing the rotation to speed up and the line separation between rings to increase until it reaches the neutral point at which time the lines wind upon themselves again tending to shorten the distance between the rings and pulls the handle rings towards each other.

An additional feature included in an alternate embodiment is damper cylinder, 15. In use, as a cylinder, 15, is disposed loosely on line, 6, in the inner space of ring, 2, while another cylinder, 15, is disposed loosely on line, 5, in the inner space of ring, 2. Cylinder, 15, is readily constructed from a soda straw. Cylinders, 15, permit air damping and stabilization of ring, 2.

It should be clear that the device is readily adaptable to any particular spatial attitude and thus may be held behind the back, over the head, etc., and thus may be used to exercise many parts of the body. Further, the amount of pull on the arms of the user, being dependent upon the amount of pull exerted by the user, is self adjusting to the weak person to the strong person and is readily usable by children and adults.

It should be understood that changes and modifications in the form, construction, arrangement, and combination of the pocket exercising device and methods of making and using the same may be made and substituted for those herein shown and described without departing from the nature and principle of my invention.

Having thus described my invention, what I claim is new and desire to secure by United States Letters Patent is:

1. A pocket exerciser device comprising, a central annular ring provided with four apertures therein, said apertures disposed essentially ninety degrees apart, first and second handle ring means, said first and second handle ring means comprising an annular ring provided with an aperture therein, first line loop means operably disposed through the aperture in said first handle ring and through a pair of apertures in said central annular ring, said pair of apertures being disposed approximately one hundred eighty degrees apart, second line loop means operably disposed through the aperture in said second handle ring and through the other pair of apertures in said central annular ring not occupied by said first line loop means as above, damper means said damper means comprising a pair of cylinders disposed about said first and second line loop means, one about each, in the space internal to the central annular ring.

* * * * *